US006040513A

United States Patent [19]

Belli

[11] Patent Number: 6,040,513

[45] Date of Patent: Mar. 21, 2000

[54] DRUM COUNTERHOOP

[75] Inventor: Remo D. Belli, Valencia, Calif.

[73] Assignee: Remo, Inc., Valencia, Calif.

[21] Appl. No.: 08/823,357

[22] Filed: Mar. 24, 1997

[51] Int. Cl.[7] ..... G10D 13/02

[52] U.S. Cl. ..... 84/411 R; 84/413

[58] Field of Search ..... 84/411 R, 413, 84/411 A, 419

[56] References Cited

U.S. PATENT DOCUMENTS

| | | | |
|---|---|---|---|
| 355,057 | 12/1886 | Buchanan | 84/413 |
| 3,185,013 | 5/1965 | Gussak | 84/411 R |
| 5,392,681 | 2/1995 | Hall | 84/413 |

*Primary Examiner*—William M. Shoop, Jr.
*Assistant Examiner*—Shih-yung Hsieh
*Attorney, Agent, or Firm*—Rapkin, Gitlin & Moser

[57] ABSTRACT

A musical drum that includes a drumhead on each end that is secured to the shell by its own counterhoop. Formed as an integral part and around the perimeter section of each of the counterhoops is a series of slotted openings defined on each side by T-shaped arm members projecting radially from the hoop. A series of cord strands are threaded through each of these openings and drawn vertically across the shell in parallel relation to one another until the drum shell is encircled. By squeezing or depressing one or more of these strands together while striking the drumhead, the drummer is able to manipulate the tones and pitches of the drum sound to enable the drum to sound as if it is "speaking."

2 Claims, 2 Drawing Sheets

FIG. 3
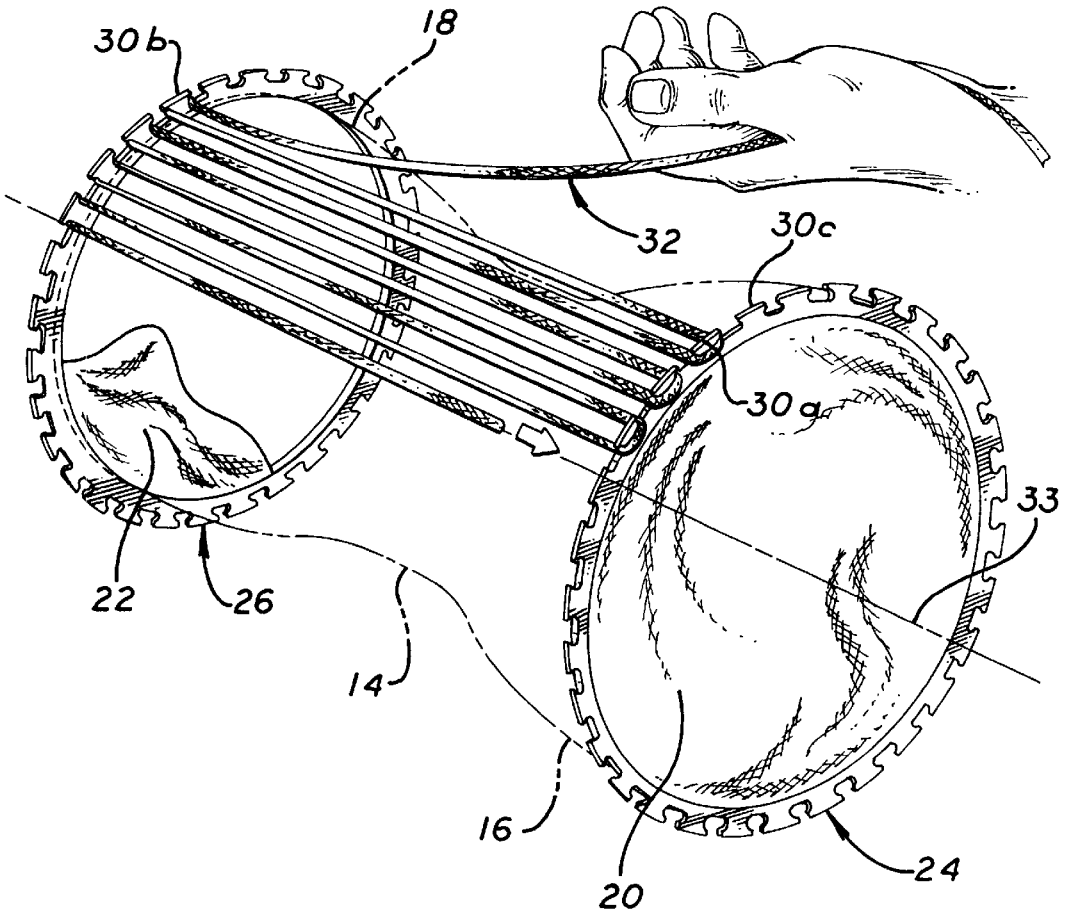
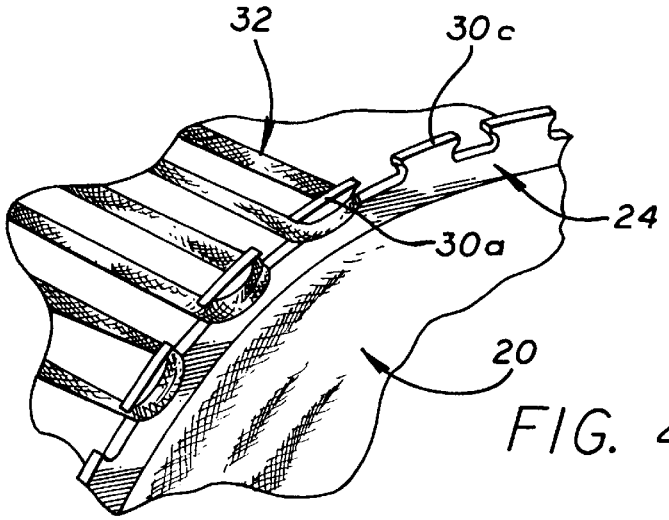
FIG. 4

DRUM COUNTERHOOP

BACKGROUND OF THE INVENTION

1. Field of the Invention

The present invention relates to musical drums, and more pairticulairly to an improvement of a type of drum employing a device that enables the drummer to simultaneously play the instrument while altering the tones and pitches of the drum sounds.

2. Description of the Prior Art

Musical drums have a rich and varied history. Drums have been used throughout time for communication and, of course, to produce musical sounds. The shell portion of the drum comes in all shapes and sizes and has been fashioned from a variety of materials, including wood, fibrous material, metal and the like. Drumheads are made from animal skins or a synthetic substitute.

The sounds that drums produce will vary depending on a number of factors, including, without limitation, the size of the drum, the material composition of the shell, the material composition of the drumhead and the tautness of the head. All these factors can have a substantial affect on the tones and pitches of the sounds that the drums produce. However, the one thing that all of these factors generally have in common is the predetermined influence that they each have on the characteristics of the drum sounds. Once in place, the effect of any of these factors tend not to vary. Thus, a shell made of a certain kind of material will affect the tone or pitch produced by the drum due to the unique characteristics of that particular material. As long as that particular material composition remains intact, i.e., does not decay for any reason, or does not contain a defect, the contribution that the material makes to the drum sound will remain relatively constant. The same is true of the drumhead material, which also embodies its own unique characteristics. As long as the drumhead material remains relatively intact and the head maintained at a constant tautness, the effect that the drumhead has on the drum sounds will also remain constant.

The tones and pitches of the drum sounds are affected by tuning. The drumhead can be tuned simply by adjusting the lug nuts that are connected to the counterhoop. The tightening of the lug nuts pulls the drumhead more taut. The tautness of the head affects the sound. Heads that do not require constant adjustment or tightening are generally referred to as "pre-tuned" heads. It is important to note that in both cases, the tautness of the drumhead is not adjusted during the actual playing of the instrument.

The Talking Drum is an instrument that employs a device that, unlike most other kinds of drums, enables the alteration of the tones and pitches of the drum sounds, most importantly, even as the drum is being played. The result of the undulating sounds is that the drum appears to be "talking" in its own special language.

Drums of this type have a unique appearance. They generally have a shape similar to an hourglass configuration and include counterhoops at each end with the means to thread or engage in some other manner cord, string or rope from one counterhoop to the other in a series of strands in a substantial parallel relation. The cord strands are spaced apart from the shell and arranged in a generally equidistant fashion around the shell wall. Most Talking Drums also include a shoulder strap to allow one hand to strike the drumhead while the other hand remains free to grab and squeeze or depress one or more cord strands in order to manipulate the tones and pitches of the sounds produced by the drum.

In the prior art, the Talking Drum has presented problems whenever the need arises to remove and replace a worn, defective or broken cord strand. The process of removing the strands and replacing them is oftentimes extremely difficult and time consuming. For example, one type of Talking Drum might include a counterhoop covered with an animal skin or synthetic counterpart containing holes through which the cord strands are threaded. Another type of Talking Drum includes a series of cord strands wrapped around the counterhoop and tied off individually in a fancy looking knot, some similar in appearance to two half hitches. Various other knots are tied in the cord strands all around the exterior surface of the drum shell. In both examples, removing and re-installing the replacement cord strands is a long and arduous task.

Accordingly, there is a need in the art to provide the Talking Drum with the means to quickly and easily replace the cord strands strung between the counterhoops.

SUMMARY OF THE INVENTION

The Talking Drum is generally fashioned in a shape similar to an hourglass configuration and includes a drumhead on each end that is secured to the shell by its own counterhoop. Formed as an integral part and around the perimeter section of each of the counterhoops is a series of slotted openings defined on each side by T-shaped arm members projecting radially from the hoop. A series of cord strands are "threaded" through each of these openings and drawn vertically across the shell in parallel relation to one another until the drum shell is encircled. By squeezing or depressing one or more of these strands together while striking the drumhead, the drummer is able to manipulate the tones and pitches of the drum sound. The instantaneous changes in these sounds makes the drum seem as if it is speaking a language of its own, or "talking."

Replacing worn, defective or broken cord strands typically is a long and arduous task. The reason for the difficulty of this task finds its origins in the kinds of devices in the prior art that are generally employed to attach the cord strands to the counterhoops. Most of these devices contain eyelets, a similar type of opening, or some other means which require the cords to be threaded through the individual opening or tied in some fancy or complex fashion throughout the entire perimeter of each of the counterhoops.

The present invention provides a plurality of space-apart T-shaped arm members defining slotted openings integrally formed about the perimeter portion of each of the counterhoops. Thus, the removal or replacement of the cord strands is easily accomplished simply by maneuvering the strands quickly and easily over and around each arm member back and forth between the counterhoops until the strands substantially encircle the drum shell. The top or horizontal section of the "T" prevents the individual cord strands from slipping off the arms inadvertently and enables the cords to be pulled as taut as necessary to create the desired sounds.

Accordingly, it is an object of the present invention to provide a device to improve the enjoyment of playing the Talking Drum.

Another object of the present invention is to provide the means to more easily remove and replace any worn or broken cord strands of the Talking Drum.

A further object of the present invention is to specifically provide the counterhoops of a Talking Drum with the means to quickly and easily remove and replace the cord strands tied between them.

Yet another object of the present invention is to provide improved counter-hoops employed with a Talking Drum that are easy and cost effective to manufacture.

Other objects and advantages of the present invention will become apparent in the following specifications when considered in light of the attached drawings wherein the preferred embodiment of the invention is illustrated.

BRIEF DESCRIPTION OF THE DRAWINGS

FIG. 3 is a perspective view of the Talking Drum of the present invention illustrating the engagement of the cord strands as they are tied to and extend between the counterhoops.

FIG. 4 is an enlarged view of the cord strands shown being manipulated and pulled taut around specific arm members integrally formed about the perimeter section of one of the counterhoops employed in combination with the present invention.

DETAILED DESCRIPTION OF THE PREFERRED EMBODIMENT

Figure 1:
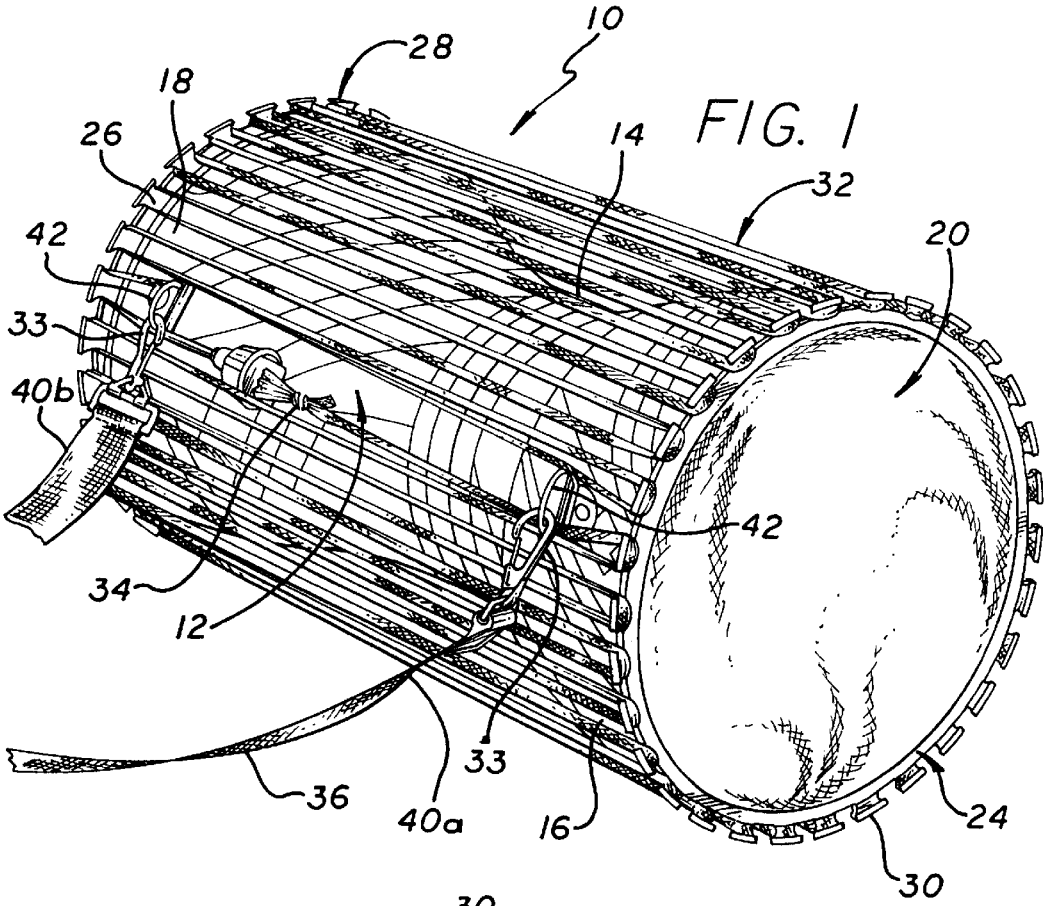
FIG. 1 is a perspective view of a conventional Talking Drum illustrating the use of the present invention.
Figure 2:
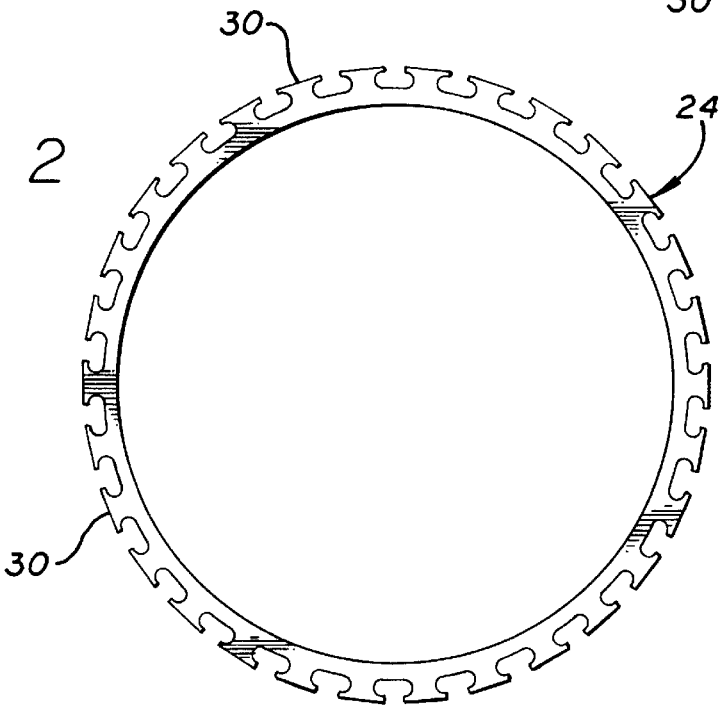
FIG. 2 is top plan view of one of the counterhoops illustrated in combination with the present invention.

FIG. 1 illustrates a conventional form of a Talking Drum 10. Talking Drums are unique in both their appearance and sound. They generally have an hourglass shaped shell 12 or some similar configuration. The shell 12 in one of its forms gently tapers towards the center portion 14. Drum 10 also comprises end sections 16, 18, which include respective drumheads 20, 22 and corresponding counterhoops 24, 26. Integrally formed along the perimeter area 28 of each of the counterhoops 24, 26 are a plurality of T-shaped arm members 30 situated in an equidistant fashion from one another. A long strand of cord 32 is wrapped around an arm member 30*a* of counterhoop 24 and extended across the vertical axis 33 of the drumshell 12 to a corresponding arm member 30*b* of counterhoop 26 at the opposite end. Cord strand 32 then is wrapped around arm member 30*b* and returned across the vertical axis 33 of drumshell 12 where the cord strand 32 is wrapped around the next arm member 30*c* in sequence, and so on. This continues in the same manner until the cord strand 32, which gives the appearance of a series of individual strands situated in parallel relation to one another, encircles the drumshell 12.

As the cord strands 32 are wound about the shell 12, they constantly are being pulled to a prescribed tightness and eventually are tied off at the end 34 using any conventional device or means for this purpose. Because each arm member 30 is formed in the shape of a "T", it is virtually impossible for any of the cord strands to slip off inadvertently once cord strands 32 are pulled to the appropriate tautness.

To remove or replace the cord strands 32, the task is relatively simple. The strands 32 care unwound airound each of the arm members 30, and pulled through simultaneously, almost in a single motion. Thus, the time it takes to complete the removal of the cord and replace it with a new one is considerably shorter than the time it used to take with the various devices of the prior art.

The Talking Drum is played by lifting the drum off the ground or some other surface and supporting the drum under one arm or through the use of an appropriate shoulder strap 36. Strap 36 includes a clip 38 connected at ends 40*a*, 40*b* to attach the strap 36 to the shell 12 using any conventional means, such as ring 42. With both hands free, the drumhead can be struck with one hand (or a stick) at either end, while the free hand, with the assistance possibly of the forearm or upper arm, grasps and squeezes or depresses several cord strands together. By squeezing or depressing the taut cord strands in this manner, the counterhoops are pulled tighter and, thus, tension the drumheads. The tensioning of the drumheads alters the heads'tonal qualities and the overall pitches of the drum sounds produced by the heads. With the Talking Drum, the heads experience tensioning at or about the moment the head is struck and the sound pitch and associated tonal qualities respond across a varied range accordingly.

Various materials may be employed for the composition of the counterhoops, though metal is preferred. The cord strands can be comprised of various materials as well, though a resilient and soft material is preferred. Given the need to squeeze or depress the cord strands to produce the desired affect, wire or any thin, hard material will tend to cut the exposed skin or, at the very least, make it uncomfortable and possibly painful to make any direct contact with the cord when attempting to achieve the desired tensioning and sounds.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended claims.

I claim:

1. A drum for emitting different tones and pitches having in combination, a drum shell, a drum head attached to each end of the drumshell, first and second counterhoops, said first counterhoop for fitting over one of said drumheads and said second counterhoop for fitting over said other drum head, and each of said counterhoops provided with a plurality of spaced-apart arm members projecting from said first and second counterhoops, each of said arm members being T-shaped to prevent a cord in threaded engagement therewith from slipping off said arm member inadvertently and provided for receiving said cord in said threaded engagement back and forth with relative speed between the arm members and each of said counterhoops forming taut cord strands in generally parallel relation to each other around and spaced apart from the drumshell, to enable two or more of said cord strands to be squeezed or pressed together when the drumhead is struck to produce changes in the tones and pitches of the sounds emanating from the drum.

2. The invention of claim 1 wherein the counterhoop is comprised of a metal alloy.

* * * * *